US008123053B2

(12) United States Patent
Elder et al.

(10) Patent No.: US 8,123,053 B2
(45) Date of Patent: Feb. 28, 2012

(54) BOOM SLEWING ACTUATOR SYSTEM

(75) Inventors: John B. Elder, Belleville (CA); Dong Sun, Belleville (CA)

(73) Assignee: EMS-Tech Inc., Belleville, Ontario (CA)

( * ) Notice: Subject to any disclaimer, the term of this patent is extended or adjusted under 35 U.S.C. 154(b) by 0 days.

(21) Appl. No.: 12/676,807

(22) PCT Filed: Sep. 5, 2008

(86) PCT No.: PCT/CA2008/001568

§ 371 (c)(1),
(2), (4) Date: Oct. 25, 2010

(87) PCT Pub. No.: WO2009/030034

PCT Pub. Date: Mar. 12, 2009

(65) Prior Publication Data

US 2011/0068075 A1 Mar. 24, 2011

(30) Foreign Application Priority Data

Sep. 7, 2007 (CA) ..... 2600932

(51) Int. Cl.
*B66C 23/84* (2006.01)

(52) U.S. Cl. ..... 212/247; 212/253; 212/181

(58) Field of Classification Search ..... 212/181, 212/253, 247

See application file for complete search history.

(56) References Cited

U.S. PATENT DOCUMENTS

| | | | | | |
|---|---|---|---|---|---|
| 1,635,689 | A | * | 7/1927 | Rauch | 384/619 |
| 1,649,739 | A | * | 11/1927 | Rosselle | 212/247 |
| 2,147,973 | A | * | 2/1939 | Ekbom et al. | 212/247 |
| 2,309,715 | A | * | 1/1943 | Rudow | 414/140.9 |
| 2,838,183 | A | * | 6/1958 | McIntyre, Sr | 212/247 |
| 3,204,720 | A | * | 9/1965 | Eitel | 182/19 |
| 4,201,305 | A | | 5/1980 | Frick | |
| 4,524,875 | A | * | 6/1985 | Jamieson | 212/239 |
| 5,078,285 | A | * | 1/1992 | Geyer et al. | 212/247 |
| 5,642,577 | A | * | 7/1997 | Kallenberger | 37/397 |
| 7,264,129 | B2 | | 9/2007 | Rilbe et al. | |

FOREIGN PATENT DOCUMENTS

| | | | |
|---|---|---|---|
| EP | 0 601 384 | * | 6/1994 |
| GB | 2114535 | | 8/1983 |

OTHER PUBLICATIONS

International Search Report; Nov. 14, 2008; PCT/CA2008/001568.

* cited by examiner

*Primary Examiner* — Michael Mansen
*Assistant Examiner* — Juan Campos, Jr.
(74) *Attorney, Agent, or Firm* — Schmeiser, Olsen & Watts LLP

(57) ABSTRACT

A slewing actuator system for rotating a boom structure comprises a cylindrical support member having lower and upper ends; a drive mounting member; gearing means comprising a gear assembly and at least one gear drive fixable to the drive mounting member and operatively connected to the gear assembly; and a boom support means to releasably secure the boom structure and operatively connectable to the gearing means. In an operating position, the boom support means is mounted proximate the upper end of the cylindrical support member and is rotatable about a substantially vertical axis; the gear assembly is substantially horizontal; and the gearing means imparts rotational movement to the boom support means. The system can include a pedestal surrounding at least part of the cylindrical support member, which can be a tube or kingpin. The compact modular system can be secured to various surfaces including ship decks and land surfaces.

30 Claims, 11 Drawing Sheets

BOOM SLEWING ACTUATOR SYSTEM

The present invention relates to a slewing actuator system for use with a boom, particularly for use in unloading cargo materials from a ship.

BACKGROUND OF THE INVENTION

Booms for loading and unloading materials, whether on land or ship decks, are known, and typically are secured to a fixed supporting point and rotatable around at least a part of a circle.

Such booms when intended for use secured to the deck of a ship, for use in unloading materials contained on the ship, are typically rotated (slewed) around a point on the deck. This rotating motion of the boom has been traditionally achieved by slewing actuators, with the boom structure typically being connected to the slewing actuator by trunnion pins. Typically, such a structure will slew from 90 degrees to 120 degrees in either direction to discharge material to another ship or on shore. Such range of motion generally relates to restrictions based on the space available on the ship deck, and not by any operational limits. Similar ground-surface based arrangements are also used for cargo movement.

A conventional slewing actuator typically comprises a hydraulically actuated rack and pinion arrangement. In such an arrangement, hydraulically actuated steel racks move back and forth to effect rotation about the rotatable pinion, which cause the boom to move. The total length of the rack governs the amount of rotation and, typically, these arrangements can take up a large amount of space in order to operate. On some ships, and other loading and unloading locations, there may be a small clearance envelope available in which such an arrangement can be positioned, and this can limit the rotational range of the boom to, for example, 90 degrees in some situations, which may not be sufficient for unloading operations.

There are other problems inherent in such slewing actuator arrangements. Firstly, slewing actuators are typically manufactured and shipped as integral units, and are not disassembled for shipping from the manufacturing facility to the shipyard or other intended use location, thus making transport by air freight or other standard means expensive and difficult, as the equipment used in these systems is very large, heavy and expensive.

Secondly, such systems can be very difficult to install, particularly when intended for use on ships, as they are typically affixed to the ship deck by kingpin bushing arrangements mounted to the ship deck, in which a vertical pin is positioned through a key opening, to the hull. This requires cooperation between the key opening and the kingpin so that a proper fit is ensured. However, achieving such compatibility can be difficult since these are each usually fabricated by different manufacturers to very tight tolerances.

Thirdly, conventional slewing actuators have a limited number of specific sizes available, often leading to extremely large, over-designed actuators, when the ideal size would have been in between two available sizes.

It would therefore be advantageous to have a slewing actuator system suitable for use on ships, land surfaces or docks, and possessing a more compact design that allows for a greater amount of rotational range of the boom attached thereto, particularly on ships or at other use locations having a small clearance envelope.

It would be further advantageous to have a slewing actuator system which is easy to install, lighter than conventional slewing actuator systems, and which can be easily disassembled into separate portions for shipping, if necessary.

It would be still further advantageous to have a boom slewing actuator system which safely prevents boom slippage which securely locks the boom in place when hydraulic pressure is removed.

SUMMARY OF THE INVENTION

The present invention discloses a rotary drive system comprising a plurality of fixed horizontally rotatable drives each of which drives a rotatable pinion gear for effecting the movement of a boom structure.

The present invention safely prevents boom slippage through having an integral brake so that when hydraulic pressure is removed (or lost due to component failure), the boom remains securely locked in place.

The present invention has a compact design, which may provide a greater amount of rotational range to a boom, is easy to install, and can be easily disassembled for shipping, if necessary.

The present invention includes several degrees of redundancy in order to prevent a system shutdown in the event of a single component failure.

The present invention is built up of several discrete components which are readily available for replacement in the event of component failure.

In a broad embodiment, the invention therefore seeks to provide a slewing actuator system for rotating a boom structure and constructed and arranged to be secured to a support structure, the system comprising:

(i) a cylindrical support member having a lower end constructed and arranged to be secured to the support structure, and an upper end;

(ii) a drive mounting member;

(iii) gearing means comprising:

(a) a gear assembly; and (b) at least one gear drive constructed and arranged to be fixed to the drive mounting member and operatively connected to the gear assembly; and (iv) a boom support means mounted to a securing means and having (a) a lower surface constructed and arranged to be operatively connected to the gearing means;

(b) an upper surface constructed and arranged to receive and releasably secure the boom structure; and (c) a central region and two lateral regions having respective outer edges;

wherein, when the system is in an operating position, (A) the boom support means is rotatably mounted proximate to the upper end of the cylindrical support member and is rotatable about a substantially vertical axis of rotation;

(B) the gear assembly is positioned substantially horizontally; and (C) the gearing means imparts rotational movement to the boom support means.

In a first more specific embodiment, the invention seeks to provide a system wherein the cylindrical support member is a tube, having an upper portion and a lower portion, and the boom support means is rotatable about the upper portion of the tube.

Preferably, the system further comprises a pedestal constructed and arranged to surround the cylindrical support member substantially concentrically for at least a portion of a height of the cylindrical support member, and preferably the pedestal comprises a substantially cylindrical inner wall and an outer wall having a cross-sectional configuration of a regular polygon.

In this embodiment, the gear assembly can be connected to the boom support means, and be rotatable about the tube, thus rotating the boom support means. Alternatively, the gear assembly can be fixedly connected to the tube, and the at least one gear drive rotates around the gear assembly and thereby rotates the boom support means.

In a second more specific embodiment, the invention seeks to provide a system wherein the cylindrical support member is a solid kingpin, and the gear assembly is connected to the boom support means, and is rotatable about the kingpin, thus rotating the boom support means.

Preferably, the support structure is selected from a base plate, a pedestal structure comprising a base plate, a pedestal structure comprising at least one support plate, a wharf, a stationary dock, a floating dock, and a ship deck.

Where the cylindrical support member is a tube, it is preferably constructed and arranged to be secured at its lower portion to the support structure, and the securing means comprises the pedestal which is constructed and arranged to rotatably surround at least the upper portion of the tube and to be secured to the lower surface of the boom support means. Alternatively, where the support structure is a pedestal comprising a support plate, the tube is constructed and arranged to be secured to the support plate.

Where the system includes a pedestal secured to the support structure, preferably the drive mounting member is constructed and arranged to be mounted on and secured by the upper surface of the pedestal. Alternatively, the drive mounting member can be mounted proximate a lower portion of the pedestal.

Preferably each gear drive comprises an integral brake. More preferably, the system comprises a plurality of gear drives each fixed substantially equidistantly from the vertical axis of rotation of the boom support means, in which case preferably each of the plurality of gear drives shares a common power source, selected from hydraulic and electrical power.

Preferably, the gear assembly has a proximal end constructed and arranged to be secured to the cylindrical support member; alternatively, the gear assembly has a proximal end constructed and arranged to be secured to the cylindrical connector.

Preferably, the gear drive comprises a pinion gear, and the gear assembly comprises (i) a rotating gear constructed and arranged to be operatively driven by each pinion gear; and (ii) a gear plate in interlocking engagement with the rotating gear. More preferably, the gear plate has a plurality of spaced-apart openings from its upper surface through to its lower surface.

Preferably, the boom support means comprises a central opening from its upper surface through to its lower surface and is constructed and arranged to rotatably surround the upper end of the cylindrical support member, and more preferably a cap plate is secured to the upper surface of the boom support means over the central opening. Further, the boom support means preferably also comprises at least one low friction bushing between the central opening and the upper end of the cylindrical support member.

Preferably, the boom support means comprises a trunnion weldment and each lateral region includes a trunnion pin. More preferably, each trunnion pin is operatively connected to one of a pair of boom hubs each constructed and arranged to be operatively connected to the boom structure.

Preferably, the cylindrical support member has an outer surface which includes an annular retaining location constructed and arranged to receive and support the lower surface of the boom support means, and more preferably the annular retaining location is selected from a protruding ledge and a detent provided at the outer surface of the cylindrical support member. Further, at least one low friction thrust washer is preferably provided between the annular retaining location and the boom support means.

Preferably, the drive mounting member is constructed and arranged to be supported at its lower surface at least proximate its lateral edges by a plurality of wing support members connected to the pedestal.

Preferably, the system further comprises an internal support ring which at least partially encloses the cylindrical support member proximate its upper end. More preferably, the cylindrical support member also has an internal reinforcing disc which substantially encloses the lower end of the cylindrical support member.

Preferably, the system further comprises a retainer plate secured to the pedestal at a lower portion.

Optionally, the system can be configured so that a horizontal distance between the vertical axis of rotation and each lateral edge of the boom support means exceeds a horizontal distance between a centre and an outer limit of the gear assembly.

The structural system of the invention and its modular construction allow for each component to be easily shipped in conventional and relatively inexpensive fashion and then easily assembled during installation at the intended end use location, or subsequently disassembled for removal to another location. Similarly, maintenance and repairs are substantially simplified. As discussed further below, the features of the present invention result in a slewing actuator system suitable for use on ships, land surfaces or docks, with a more compact design, allowing for a greater amount of rotational range of the boom, and at the same time safely preventing boom slippage, and which securely locks the boom in place when hydraulic pressure is removed.

BRIEF DESCRIPTION OF THE DRAWINGS

The embodiments of the present invention will now be described by reference to the following figures, in which identical reference numerals in different figures indicate identical elements and in which.

DETAILED DESCRIPTION OF THE INVENTION

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

Figure 1:
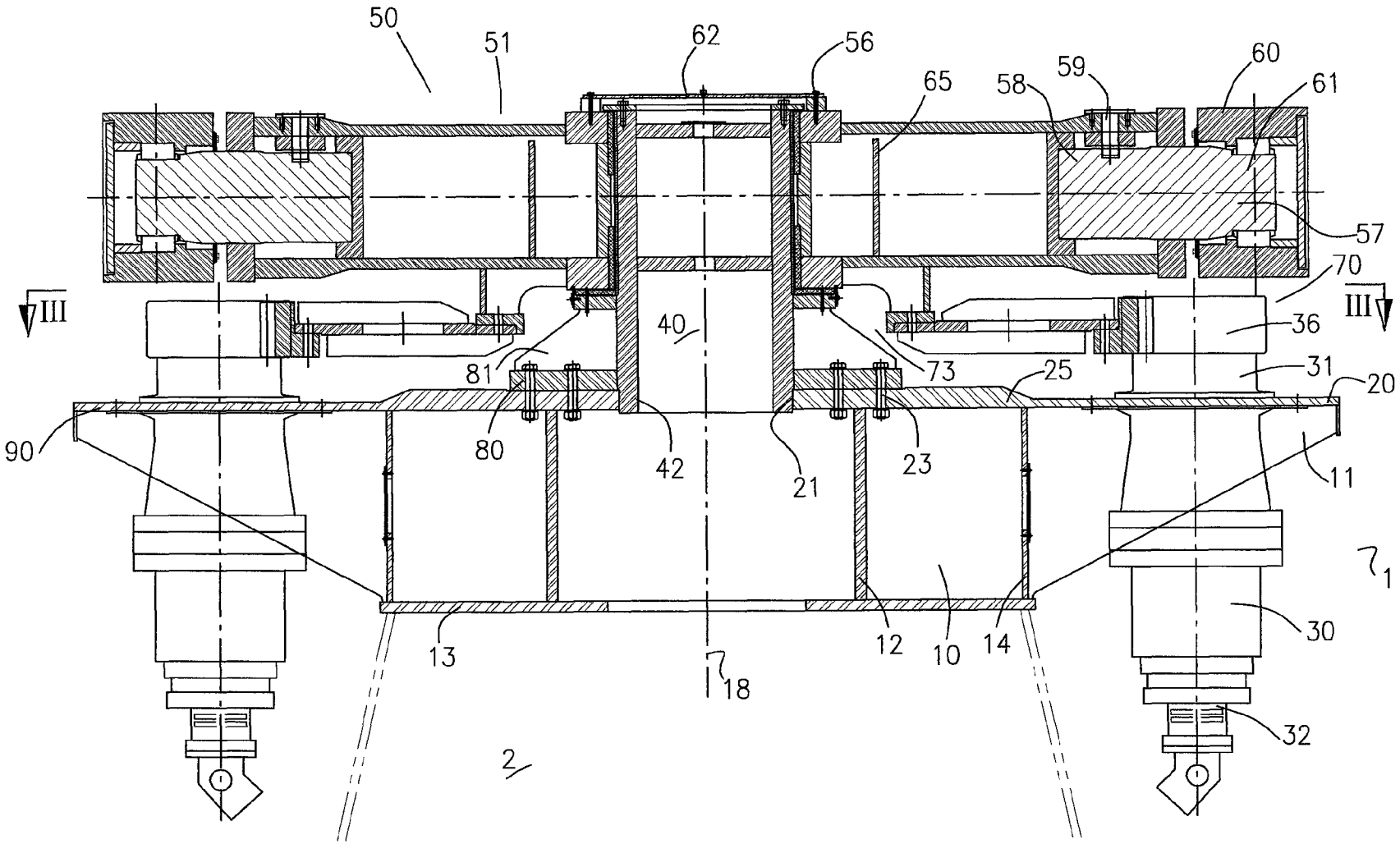
FIG. 1 is a vertical cross-sectional view of a first embodiment of the invention.

Referring to FIG. 1, a first exemplary embodiment of the boom slewing actuator system 1 of the invention is shown in an operational position. The slewing actuator system 1 comprises a pedestal 10, having an inner circular wall 12, and an outer wall 14, preferably having a cross-sectional configuration of a regular polygon, the pedestal 10 being mountable on a support, shown here as a base plate 13 affixed to the support 2, such as a ship deck or a dock. Affixed to the upper surface 90 of the pedestal 10 is a drive mounting plate 20, having a central opening providing a tube-receiving location 21. At an upper surface of the drive mounting plate 20 adjacent the central opening, a support plate 80 contributing to the tube-receiving location 21 is affixed, for example secured by bolts 23. Similarly mounted on an upper surface of the support plate 80 is a stiffening ring 81.

A cylindrical support, in this embodiment a tube 40, is affixed with its lower end 42 secured by the perimeter of the tube-receiving location 21 provided by the central openings in the drive mounting plate 20 and the support plate 80.

Figure 2:
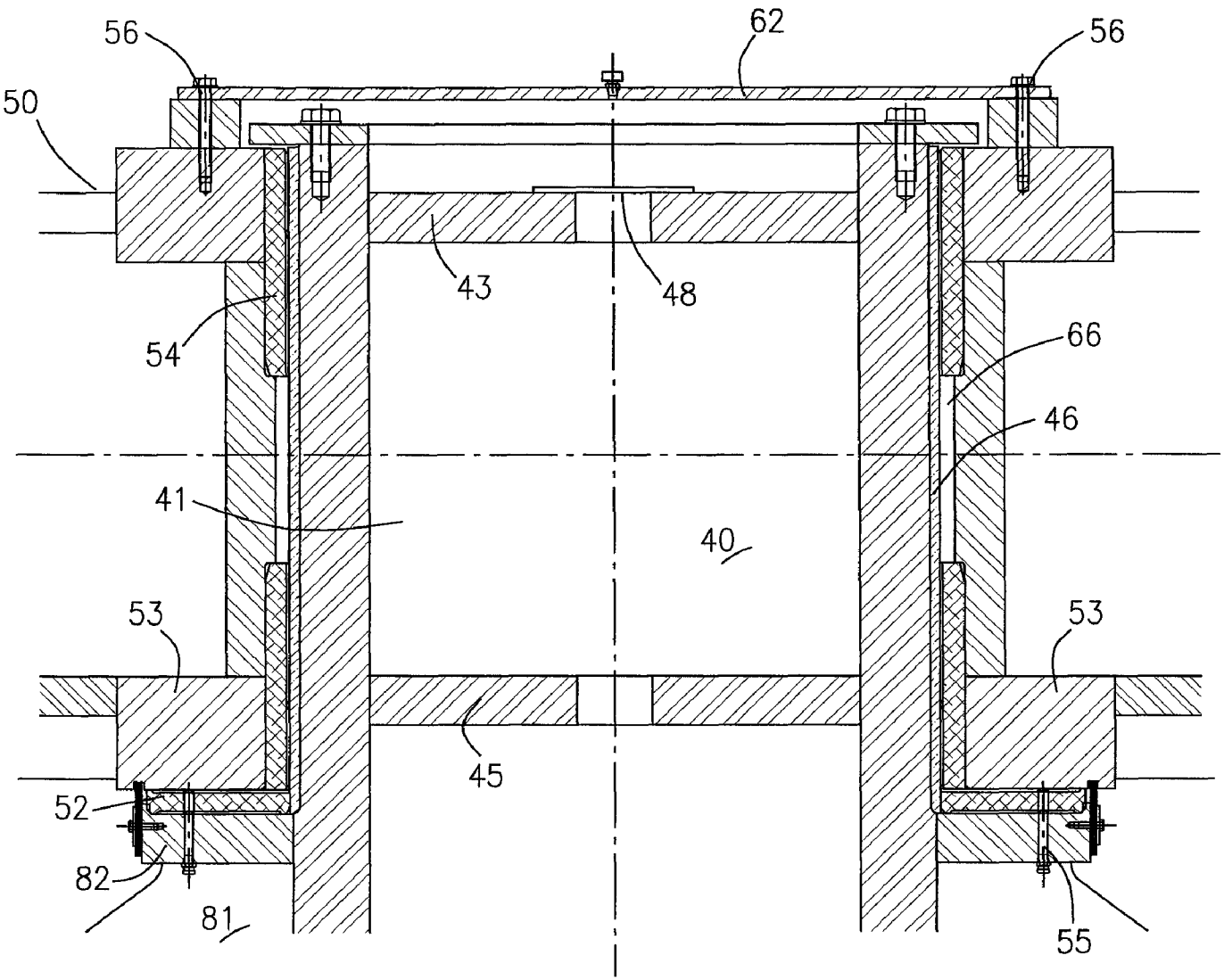
FIG. 2 is an enlarged cross-sectional view showing the connection of the cylindrical support to the boom support means in the embodiment of FIG. 1.

Referring also to FIG. 2, the upper portion 41 of the tube 40 is provided with a mounting ring 82, secured to an upper surface of the stiffening ring 81. A boom support means, shown here as a structure known in the art as a trunnion weldment 50, having a central cylindrical opening 66, is mounted in a clearance fit over the upper portion 41 of the tube 40, being dimensioned to be selectively rotatable about the tube 40, and secured in the rotatable position by the cooperation of shoulders 53 adjacent the lower edge of the trunnion weldment 50, the tube 40 and the stiffening ring 81. Bushings 54 and thrust washers 52 are provided as shown between the trunnion weldment 50 and the tube 40, to allow for smooth rotation of the trunnion weldment 50 and reduce wear. The upper portion 41 of the tube 40 is preferably covered by a very thin outer tube 46, preferably of stainless steel, in order to provide the appropriate surface hardness required for the bushings 54. Lubrication of the regions of contact can be effected through lubrication fittings 55.

For additional strength and stability, and to maintain the integrity of the load-bearing tube 40, it can be provided with one or more reinforcing rings, shown in FIG. 2 as upper and lower reinforcing rings 43 and 45 respectively, the upper reinforcing ring preferably comprising a disc 48 to seal the upper end of the tube 40.

At each lateral portion of the trunnion weldment 50, trunnion pins 57 are provided to enable the securing of a boom hub 60. A proximal end 58 of each trunnion pin 57 is secured to the trunnion weldment 50 by locking pins 59, and the boom hub 60 is mounted on a distal end 61 of each trunnion pin 57, each of the boom hubs 60 having respective ends of the selected boom structure (not shown) secured and mounted thereon.

Within the intermediate portion 51 of the trunnion weldment 50, reinforcement means can be provided, preferably steel stiffeners 65.

A cap plate 62 is secured, for example by bolts 56, to the upper surface of the trunnion weldment 50 adjacent the central opening 66, so as to cover the top of the central opening 66, and inhibit or prevent water, dirt or other particulates from entering the central opening 66 and coming into contact with or potentially inhibiting the movement of trunnion weldment 50 around the tube 40, or becoming lodged in spaces between the tube 40 and thrust washers 52 and bushings 54.

The pedestal 10 has vertical stiffeners, such as stiffening wings 11, secured to the outer pedestal wall 14, and extending radially outward from the central vertical axis 18 of the system, to provide support to the drive mounting plate 20 at its lower surface along a desired distance, which may be up to the outer perimeter of the drive mounting plate 20, while not interfering with any portion of the plurality of gear drives 30, discussed further below, as may extend below the drive mounting plate 20.

Figure 3:
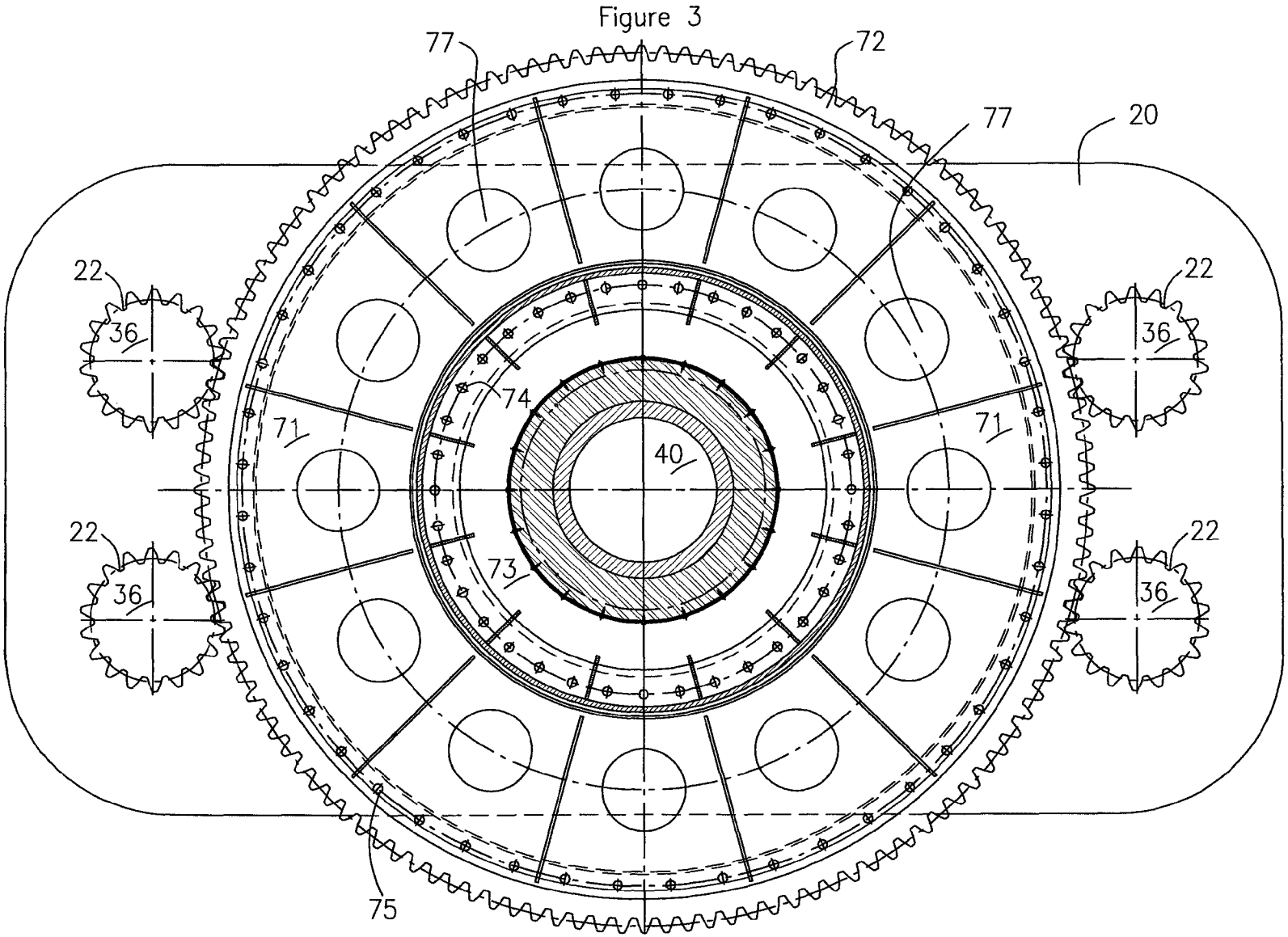
FIG. 3 is a sectional view along the lines in FIG. 1.

Referring now also to FIG. 3 together with FIG. 1, the drive mounting plate 20 comprises a substantially planar surface having a plurality of openings 22 in spaced-apart relation a constant distance radially outward from the central vertical axis 18. The thickness (in the vertical direction when in operation) of the drive mounting plate 20 is selected so as to minimize the weight of the plate, while providing sufficient strength for its support functions. Increased thickness can advantageously be provided in the region between the central opening and the location of the outer wall 14 of the pedestal 10, for example as shown at 25.

Referring again to FIG. 1, each of the plurality of gear drives 30 is a rotational drive system and is adapted to be mounted in one of the openings 22 provided in the drive mounting plate 20, so as to extend downwardly and substantially perpendicular to the drive mounting plate 20. Each of the gear drives 30 mounted on the drive mounting plate 20 drives a corresponding pinion gear 36 which meshes with the gear assembly 70 (discussed in more detail below in relation to FIG. 4), whereby the pinion gears 36, when driven by the gear drives 30, cause the gear assembly 70 to rotate, and thus to provide the desired selected rotation of the trunnion weldment 50.

Although a substantial portion of each of the gear drives 30 extends downwardly from the drive mounting plate 20, an upper portion 31 of the gear drives 30 extends upwardly above the drive mounting plate 20.

Figure 4:
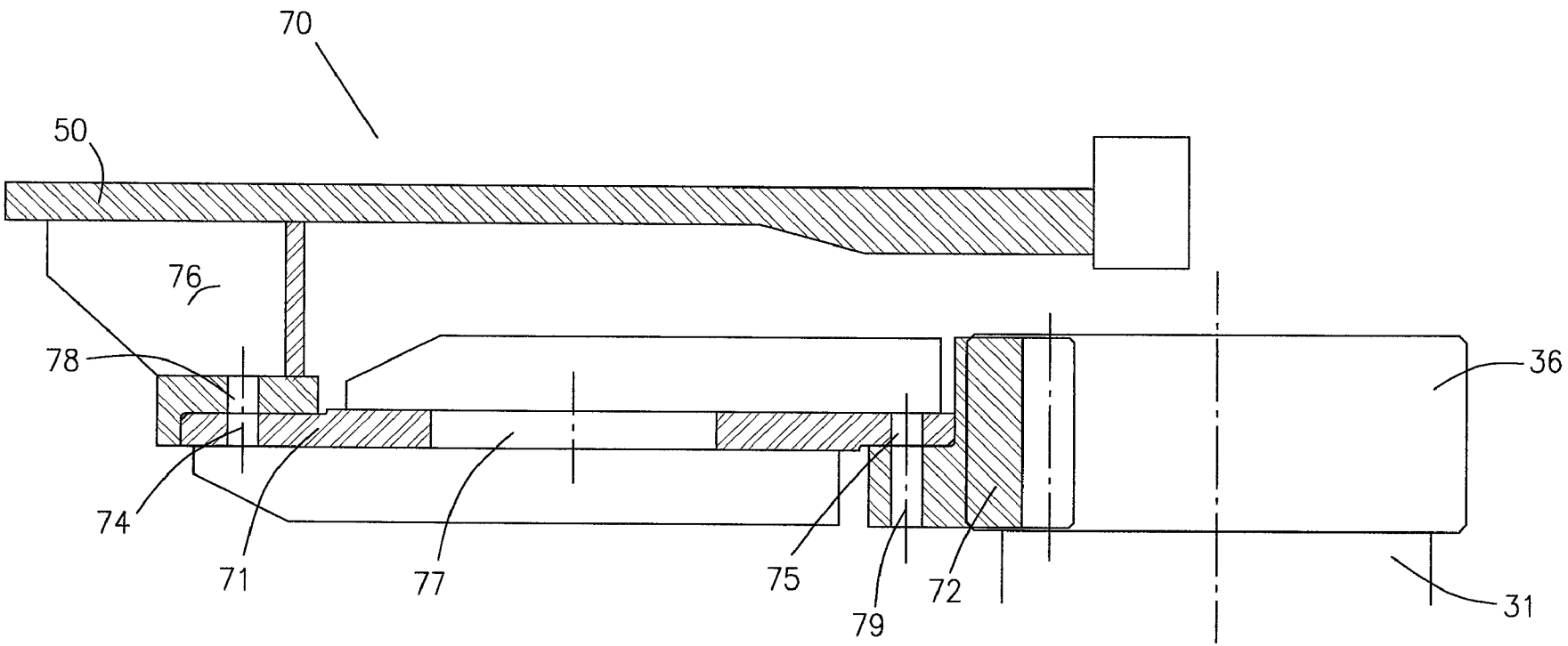
FIG. 4 is an enlarged cross-sectional view of the gear assembly of the invention.

Referring now to FIG. 4, the gear assembly 70 comprises a connecting ring 76, a gear pedestal plate 71 and a large circular gear 72.

The connecting ring 76 is rigidly secured on an underside of the trunnion weldment 50, preferably by welding, such that it descends downwardly from the trunnion weldment 50 and is positioned, when the trunnion weldment 50 is mounted upon the tube 40, around an outside circumference of both the central opening 66 in the trunnion weldment 50 and the tube 40.

The connecting ring 76 is secured to the gear pedestal plate 71 by any suitable means, such as by pins or bolts (not shown), and the gear pedestal plate 71 supports the large circular gear 72.

The gear pedestal plate 71 comprises a large substantially planar surface having a central opening 73 (see FIG. 1), which is configured to be coaxial, in an operational position, with the central vertical axis 18.

Referring again to FIG. 3, the gear pedestal plate 71 has a plurality of inner bolt circles 74 defined thereon, positioned proximate to an outside circumference of the central opening 73 in the gear pedestal plate 71. These inner bolt circles 74 correspond to openings 78 in the lower surface of the connecting ring 76, as seen in FIG. 4, whereby the gear pedestal plate 71 can be secured to the connecting ring 76 by any suitable means, such as pins or bolts (not shown).

The gear pedestal plate 71 also has a plurality of outer bolt circles 75 positioned thereon proximate its outer circumference, corresponding to securing openings 79 provided in the circular gear 72, whereby the plate 71 can be secured to the circular gear 72 by any suitable means, such as by pins or bolts (not shown).

Preferably, a plurality of holes 77 extend throughout the surface of the gear pedestal plate 71, so as to reduce the weight of the plate 71, and to provide for drainage. These holes 77 are arranged around a circumference of the gear pedestal plate 71, and between the inner bolt circles 74 and the outer bolt circles 75.

Referring to FIGS. 1 and 4, the circular gear 72 meshes with the pinion gears 36, and extends around an outside circumference of the plate 71. The circular gear 72 has a thickened lower portion having securing openings 79 therein, upon which a portion of the plate 71 near to and inside its outer circumference can be secured. In operation, the pinion gears 36, when driven by the gear drives 30, cause the circular gear 72 to rotate, which correspondingly causes the trunnion weldment 50, and the boom structure rigidly secured thereto, to rotate around the tube 40 to a desired position, without interference from the gear drives 30 positioned underneath the trunnion weldment 50.

Preferably, all of the pinion gears 36 are simultaneously supplied from a suitable common power source 37 including hydraulic power and electric power. If the common power source 37 is hydraulic, so that the pressure between the pinion gears 36 will automatically equalize, thus keeping the pinion gears 36 in synchronization.

Additionally, each of the gear drives 30 preferably has a normally locked in line, spring applied integral brake 32 (see FIG. 1). When there is no hydraulic pressure, the springs within the brake will lock the drive shaft, preventing it from rotation. When hydraulic pressure is applied, the spring pressure will be counteracted, and the lock will release. In the absence of hydraulic power, there is no further rotation of the pinion gears 36 or unloading boom structure indirectly attached thereto, so that the boom structure at all times remains positively locked in place, thus preventing slippage of the boom, without the application of hydraulic power.

Figure 5:
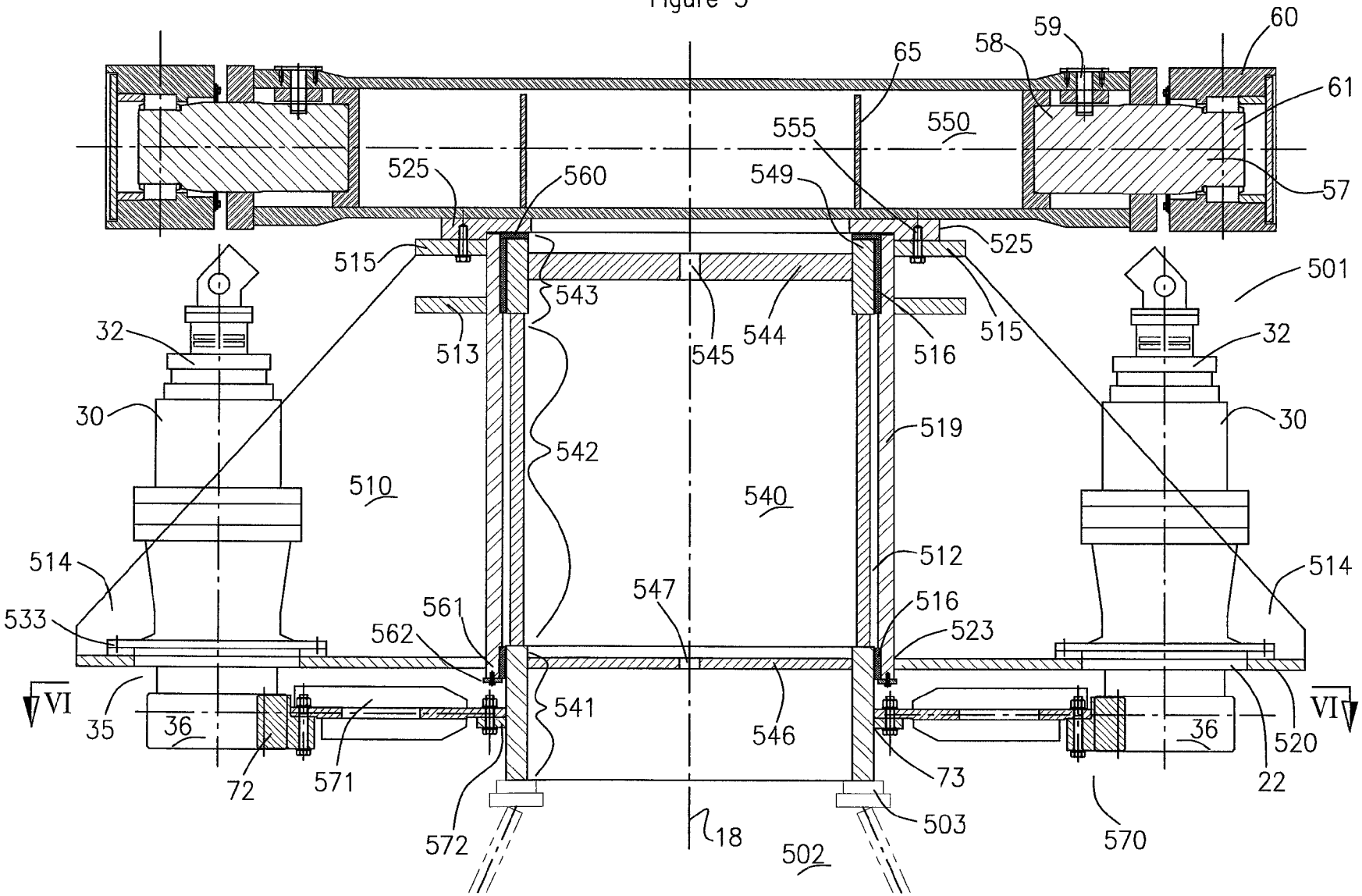
FIG. 5 is a vertical cross-sectional view of a second embodiment of the invention.

Referring now to FIG. 5, a second exemplary embodiment 501 of the boom slewing actuator system of the present invention is shown. The configuration of this embodiment is particularly advantageous in situations where there is limited clearance space available on the support surface, such as a ship deck or a land surface. In this embodiment, the gear drives 30 and the pedestal 10 are inverted from their respective positions in the first embodiment discussed above in relation to FIGS. 1 to 4, to provide a low clearance solution and a more compact design.

Furthermore, unlike its position in the first embodiment, the trunnion weldment 550 is rigidly secured directly to the pedestal 510, the trunnion weldment 550 and the pedestal 510 combining to form a single unit that is rotatably mounted upon, and substantially covers, the tube 540.

The cylindrical support, shown here as tube 540, is preferably constructed of steel and rigidly mounted on the deck or other support surface (not shown), either directly or, as shown in FIG. 5, to a supporting platform 503, which is in turn mounted to an intermediate support structure 502, which is itself rigidly mounted on the support surface. The tube 540 is preferably connected to the support structure 502 by welding, though it will also be readily apparent to one skilled in the art that other means could be used. Support platform 503, which is optionally positioned between the support structure 502 and the tube 540, serves to provide a stable flat surface on which to mount the tube 540.

In this embodiment, the tube 540 consists of lower, middle and upper portions, respectively 541, 542 and 543, the outermost diameter of each of the lower portion 541 and the upper portion 543 being slightly greater than the outermost diameter of the middle portion 542. Preferably, such difference is achieved by thickening the lower portion 541 and upper portion 543 relative to the middle portion 542. These thickened portions bear a greater share of the load on the tube 540 imposed by pedestal 510 being rotatably mounted thereon, as discussed below, while the reduced thickness of the middle portion 542 reduces points of contact with the pedestal 510 for ease of installation, and incidentally results in cost savings associated with the types of bushings 516 which can be used.

The upper portion 543 of the tube 540 has an annular internal support ring 544 formed at the top thereof, partially enclosing (but for a central opening 545, which acts as a sighting and alignment hole) the interior of the upper portion 543 of the tube 540. Similarly, the lower portion 541 of the tube 540 preferably also has an internal reinforcing disc 546 which can enclose the lower portion 541 proximate the top of that portion, but for a central opening 547.

Preferably, the support ring 544 and the reinforcing disc 546 are both made of steel. The dimensions and configuration of the support ring 544 and reinforcing disc 546 can be varied, as appropriate, corresponding to the amount of load expected to be borne by the tube 540.

In the operating position, the pedestal 510 slides over and surrounds the tube 540, in a loose fit, the pedestal 510 having a vertical cylindrical cavity 512 defined therethrough by an interior pedestal wall 519 which is coaxial with the central vertical axis 18.

At the upper surface of the pedestal 510, support plates 515 are affixed, on an upper surface of which a mounting portion 525 is secured, to receive and secure the trunnion weldment 550. At the upper and lower ends of the pedestal 510, bushings 516 are fixed to the interior of the interior pedestal wall 519, to cooperate in the operating position with the upper portion 543 and bottom of the lower portion 541 of the tube 540, respectively.

In this manner, the pedestal 510 may be rotated about the vertically extending tube 540, without interference from the support structure 502 upon which the tube 540 rests.

Preferably the pedestal 510 has vertical stiffeners, such as stiffening wings 514, secured to the interior pedestal wall 519, and extending radially outward from the central vertical axis 18 of the system, to provide support to the drive mounting plate 520 at its upper surface along a desired distance, which may be up to the outer perimeter of the drive mounting plate 520, while not interfering with any portion of the plurality of gear drives 30, discussed further below, as may extend above the drive mounting plate 520.

The pedestal 510 preferably also has a steel stiffening band 513 formed internally within an upper portion of each of the vertical stiffeners 514, which extends laterally across a partial internal width of the vertical stiffeners 514. The stiffening band 513 provides additional support to the pedestal 510 in handling loads placed upon the pedestal 510 by trunnion weldment 550. Similarly, the interior pedestal wall 519 of the pedestal 510 can also be thickened or reinforced if desired.

The interior pedestal wall 519 of the pedestal 510 extends at its lower edge 561 below the drive mounting plate 520, so as to provide sufficient contact area for the lower bushing 516. At the edge 561, a securement ring 562 can be attached to assist in maintaining the desired positioning of the associated bushing 516.

The inverted positioning of the gear drives 30 in this embodiment, as compared with the embodiment shown in FIG. 1, thus permits a lower clearance structure, and allows the boom to be mounted closer to the support surface such as a ship's deck, with a lower centre of gravity and, in the case of mounting on a ship or other movable support, a correspondingly increased stability despite any movement of the support surface.

The drive mounting plate 520 comprises a large substantially planar surface, and is secured to a lower surface of the pedestal 510, preferably by welding. The drive mounting plate 520 supports and positions the gear drives 30, as discussed below, and has a central opening 523 coaxial, in an operational position, with the central vertical axis 18. The central opening 523 is dimensioned so that the drive mounting plate 520 abuts the interior pedestal wall 519.

In the same manner as for drive mounting plate 20 in FIG. 1, drive mounting plate 520 comprises a plurality of openings 22 in spaced apart relation a constant distance radially outward from the central opening 523, each sized to accept and support one of the plurality of gear drives 30. In this embodiment, a substantial portion of each of the gear drives 30 will extend vertically above the drive mounting plate 520, while a lower portion 35 of the gear drives 30 and the gear assembly 570 will extend below the drive mounting plate 520. In the illustrated embodiment, as shown in FIG. 6, four separate gear drives 30 are shown, though it will be readily apparent to one skilled in the art that variations as to the actual number of gear drives present can be made.

Although the gear drives 30 are identical to those shown in FIG. 1, they are each provided with a mounting portion 533 which has a greater diameter than that of the openings 22, to provide a mounting surface for the gear drives 30.

As can be seen from FIG. 5, the gear assembly 570 is substantially identical to gear assembly 70 shown in FIGS. 1 and 2, and comprises a gear ring support 572, a gear pedestal plate 571 and a large circular gear 72.

Figure 6:
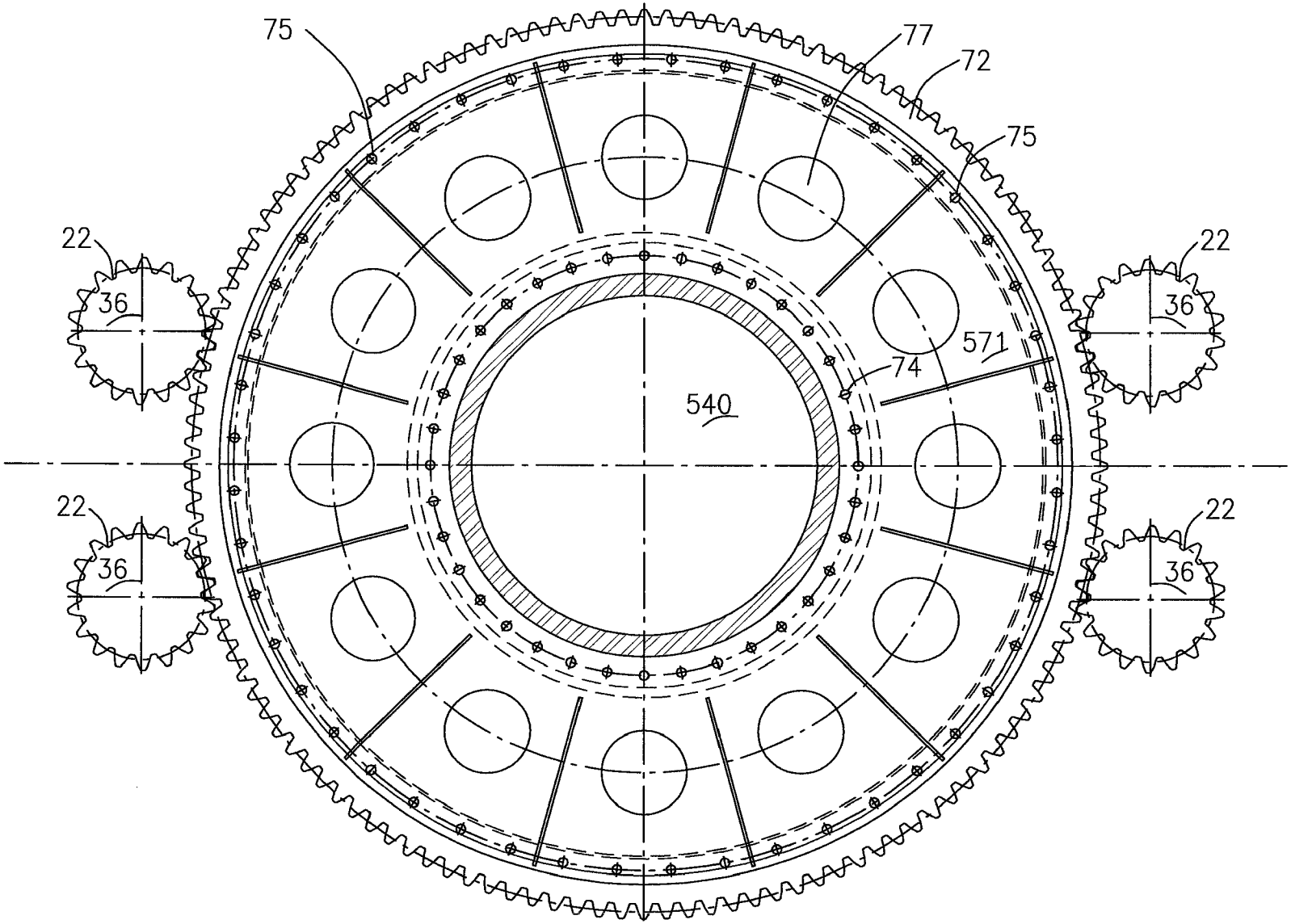
FIG. 6 is a sectional view along the lines VI-VI in FIG. 5.

With reference also to FIG. 6, gear pedestal plate 571 has a plurality of inner bolt circles 74 defined therealong which surround an outside circumference of the central opening 73 in the gear pedestal plate 571, whereby openings (not shown) in the gear ring support 572 are aligned with the inner bolt circles 74 to secure the gear pedestal plate 571 to the gear ring support 572 by any suitable means, such as pins or bolts (not shown).

The gear pedestal plate 571 also has a plurality of outer bolt circles 75 positioned thereon proximate its outer circumference. These outer bolt circles 75 correspond to securing openings (not shown) in the circular gear 72, whereby the gear pedestal plate 571 can be secured to the circular gear 72 by any suitable means, such as pins or bolts (not shown).

Gear ring support 572 is connected, preferably by welding, to an outside surface of lower portion 541 of the tube 540, such that it extends outwardly therefrom while, at the same time, being vertically positioned at a sufficient height whereby there is no interference with rotation of the pedestal 510, and correspondingly the trunnion weldment 550, about the tube 540, from any of the support structure 502 or the support platform 503.

In operation, none of the components of the gear assembly 570 rotates, but instead the pinion gears 36, when driven by the gear drives 30, rotate and move about the stationary circular gear 72 in a desired direction, causing the pedestal 510, trunnion weldment 550 and the boom structure (not shown) attached thereto, to correspondingly rotate about the tube 540 and be positioned where desired. The inverted gear drives 30, by virtue of their connection to the drive mounting plate 520 secured to the pedestal 510, will also likewise correspondingly rotate about the tube 540 when the pedestal 510 rotates about the tube 540.

The rotational range of the pinion gears 36 in moving around the stationary circular gear 72, and the corresponding rotational movement of the boom structure (not shown) is only a portion of a complete revolution. Nevertheless, the rotating portion is not restricted from so doing by the space available on the support surface (not shown) as is the case with conventional slewing actuator systems. In this embodiment, rotation of such a structure may be restricted and in a range of 180-200° from a center position. Since the boom structure is constrained from complete rotation, the hydraulic lines (not shown) connected to the gear drives 30 will not get crossed during the slewing motions.

Preferably, the gear drives 30 are powered and supplied with an integral brake in the same manner as for the first embodiment, as discussed above.

This embodiment thus provides a smaller support structure, and a vertically more compact design than the first embodiment or known structures.

Referring again to FIG. 5, the trunnion weldment 550 is mounted onto the pedestal 510, and, as with the first embodiment described in relation to FIGS. 1 to 4, is used to support a boom structure (not shown). However, in this embodiment, the trunnion weldment 550 is preferably constructed as a substantially solid piece. In this manner, when secured to the pedestal 510, the trunnion weldment 550 effectively covers the top of the tube 540, thus rendering superfluous the cap plate 62 (shown in FIG. 1).

As noted above, mounting portion 525 of the trunnion weldment 550 is mounted and secured to support plate 515 by suitable means such as bolts 555, and is thereby rigidly secured to and covers the pedestal 510.

Thrust washers 560 are provided between a lower surface of cylindrical mounting portion 525 of the trunnion weldment 550 and an upper lip 549 of the tube 540, so as to provide a low friction sliding surface for the rotation of the pedestal 510 and the trunnion weldment 550 about the tube 540.

The lateral portions of the trunnion weldment 550 are preferably constructed in the manner described in relation to the embodiment shown in FIG. 1, and reinforcing stiffeners 65 are preferably also provided in the same manner as described above.

Referring now to FIGS. 7 to 10, a third embodiment 701 of a boom slewing actuator system of the invention is shown.

This embodiment has a substantially similar construction to that of the first embodiment, in relation to the features, configuration, orientation and securing of each of the pedestal 10, drive mounting plate 20, gear drives 30, gear assemblies 70, and the general construction of the trunnion weldment 50, so that these will not be described further in relation to this embodiment.

However, instead of the tube 40 of the first embodiment, this third embodiment comprises a substantially cylindrical kingpin 740, which is secured directly or indirectly to the support surface 2, as discussed below, and is secured to the drive mounting plate 20 at the upper surface of pedestal 10. The kingpin 740 provides by means of a selected variation in its outer surface a support location on which the lower portion of the trunnion weldment 50 can rest securely, the kingpin being received in the central opening 51 of the trunnion weldment 50, whereby the trunnion weldment 50 can rotate around the upper portion of the kingpin 740 about the central vertical axis 18.

Figure 7:
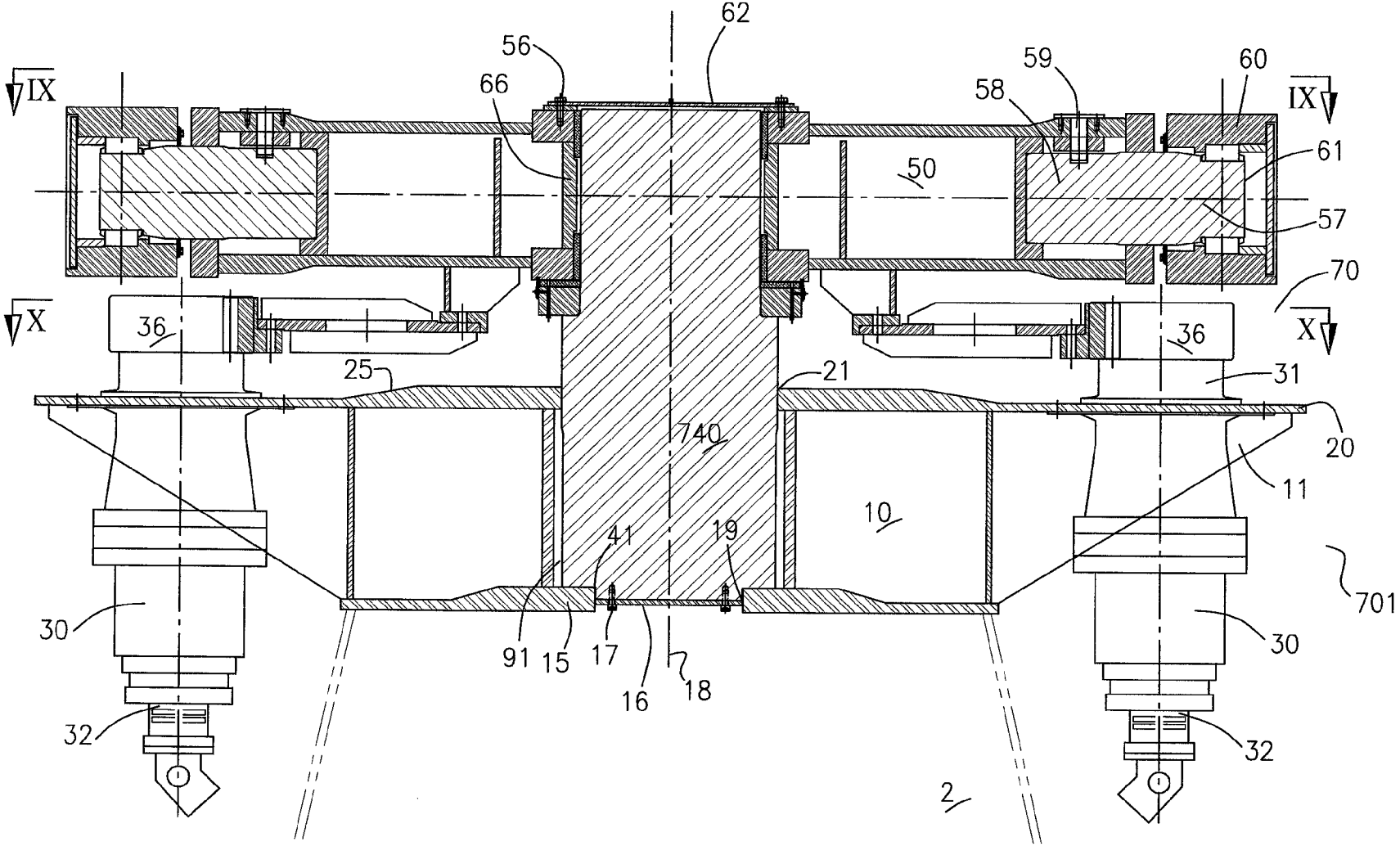
FIG. 7 is a vertical cross-sectional view of a third embodiment of the invention.

As can be seen from FIG. 7, the pedestal 10 has a vertical cylindrical cavity 91 coaxial with the central vertical axis 18, in which the kingpin 740 can be supported and retained in a vertical position. The lower edge of the pedestal 10 is preferably secured to a circular interior base wall 15 to form a cylindrical shoulder which engages a detent 41 on the kingpin 740. For ease in installation, preferably, the circular interior base wall 15 has an opening 19, which can be closed by a retainer plate 16 which is preferably welded in place to the interior base walls 15. The kingpin 740 can be secured to the retainer plate by any suitable means, for example by bolts 17 through the retainer plate 16, and can thereby be secured to the support surface 2.

When in such position, the kingpin 740 is rigidly mounted, so that unlike conventional systems, no keying system is required, and the close fit which can be achieved by this construction provides accurate mounting and secure support against tilting.

The kingpin 740 is secured within the central opening 21 provided adjacent the drive mounting plate 20, and preferably the thickness of the drive mounting plate 20 is increased at that location as shown at 25, so as to provide additional support to the kingpin 740 in an upright position against stresses resulting from those imparted on the trunnion weldment 50 by the weight of the boom (not shown).

Figure 8:
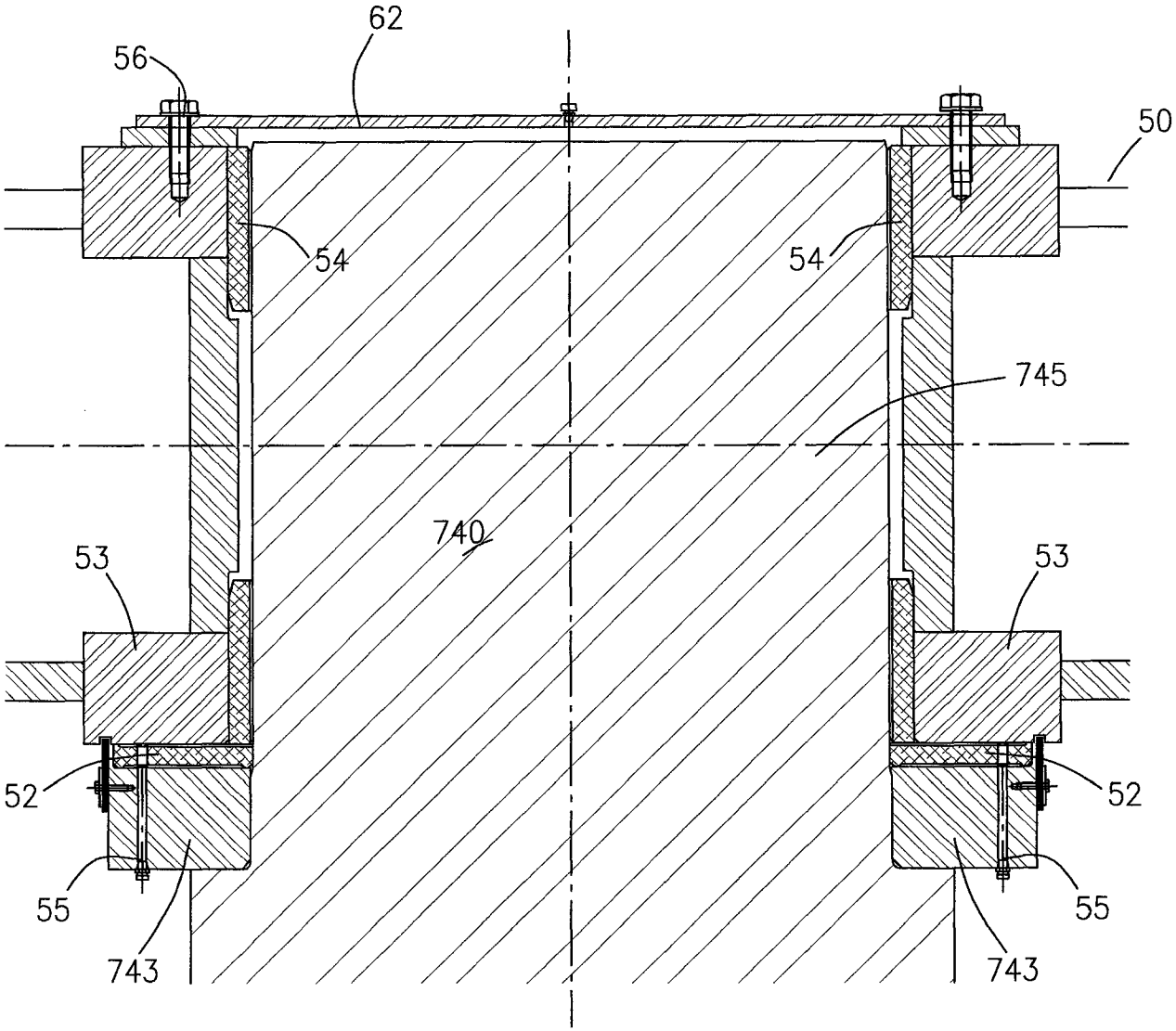
FIG. 8 is an enlarged cross-sectional view showing the connection of the kingpin to the boom support means in the embodiment of FIG. 7.

Referring now to FIG. 7 together with FIG. 8, at an upper portion 745, the outside diameter of the kingpin 740 is narrowed, for example by a detent or upper shoulder 743 machined upon the upper portion 745, configured to receive and retain in a sliding fit the lower edge 53 of the trunnion weldment 50. As shown in FIG. 8, preferably thrust washers 52 are provided between the lower edge 53 of the trunnion weldment 50 and the upper shoulder 743 of the kingpin 740. As in the embodiment shown in FIGS. 1 and 2, the thrust washers 52 are low friction rings that transmit any vertical load from the trunnion weldment 50 into the kingpin 740, and provide a sliding surface for the rotation of the trunnion weldment 50 about the kingpin 740.

Similarly bushings 54 are preferably fixed to the interior of the trunnion weldment 50. Additionally, grease or other lubricants such as would be known to those having ordinary skill in this art may be fed by way of lubrication fittings 55 into the bushings 54 and thrust washers 52 to further reduce friction between the kingpin 740 and the trunnion weldment 50 positioned thereon.

As in the embodiment shown in FIG. 1, preferably a cap plate 62 is secured to the upper surface of the trunnion weldment 50, by any suitable means such as bolts 56.

Figure 9:
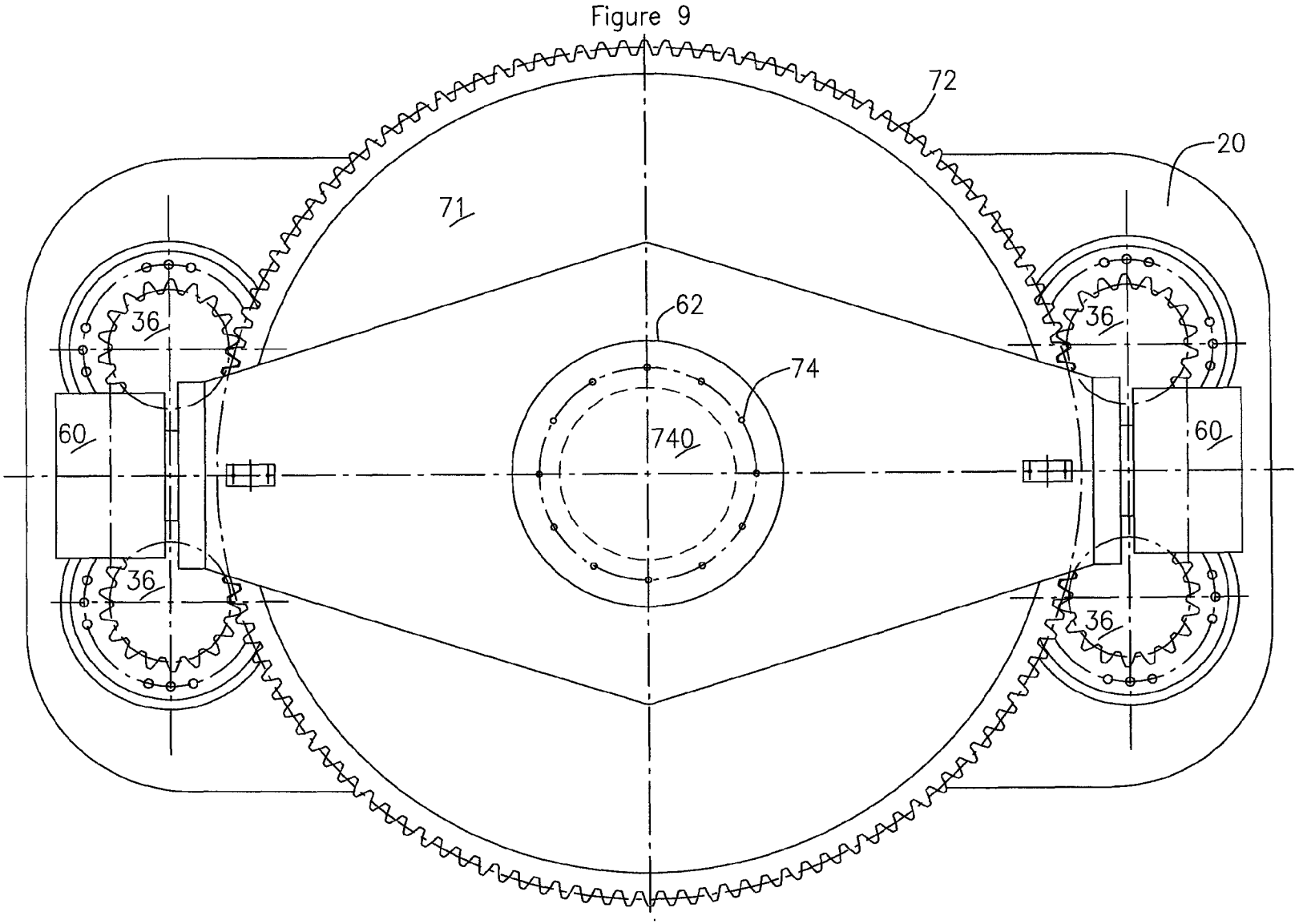
FIG. 9 is a top view of the third embodiment, taken along the lines IX-IX in FIG. 7.

Referring now to FIG. 9, it can be seen that the configuration and the relationship of the drive mounting plate 20 and the pinion gears 36 are substantially as in the embodiment shown in FIG. 1, and the configuration of the boom hubs 60 and the cap plate 62 can also be seen, as well as the location of the kingpin 740.

Figure 10:
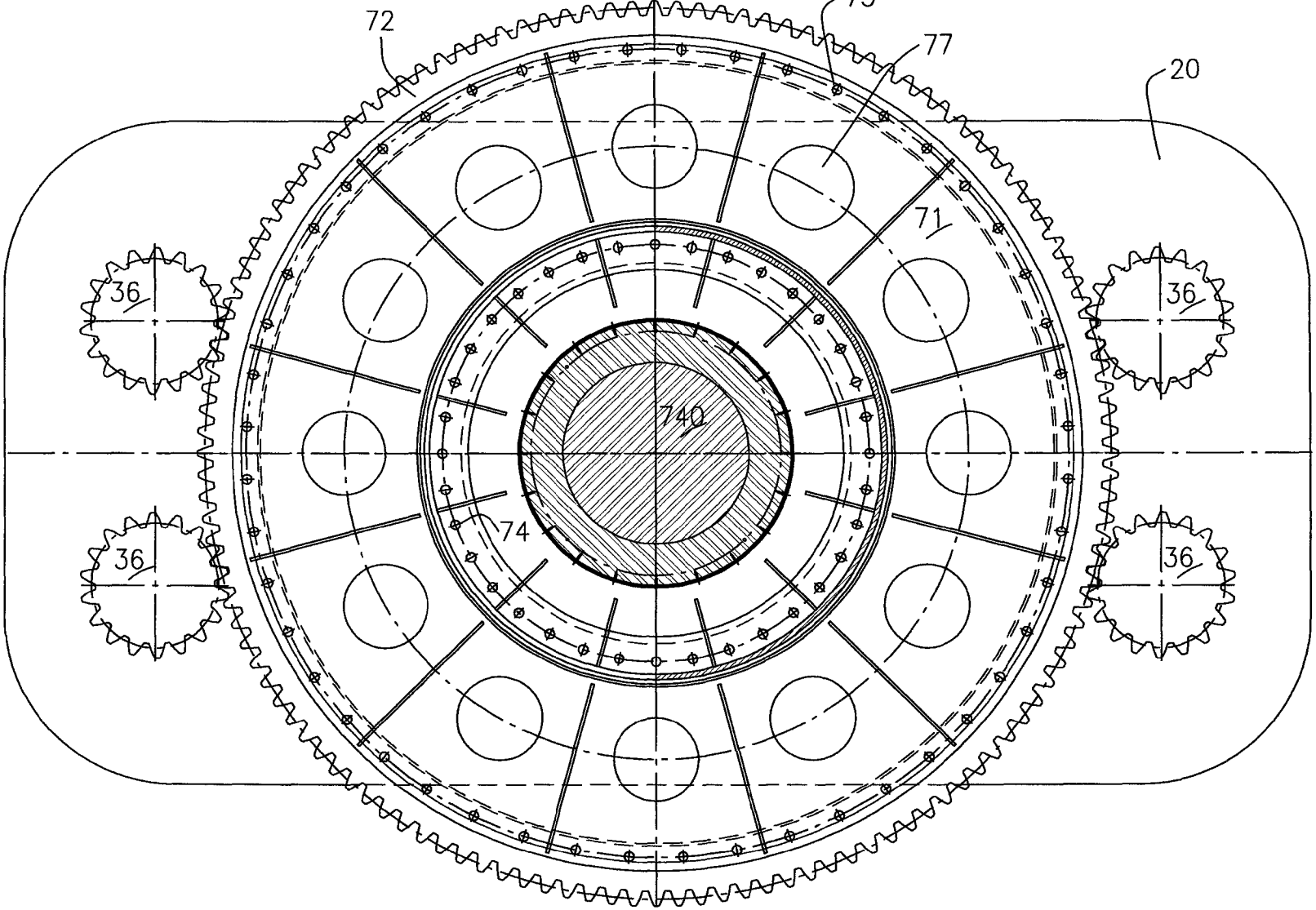
FIG. 10 is a sectional view along the lines X-X in FIG. 7.
Figure 11:
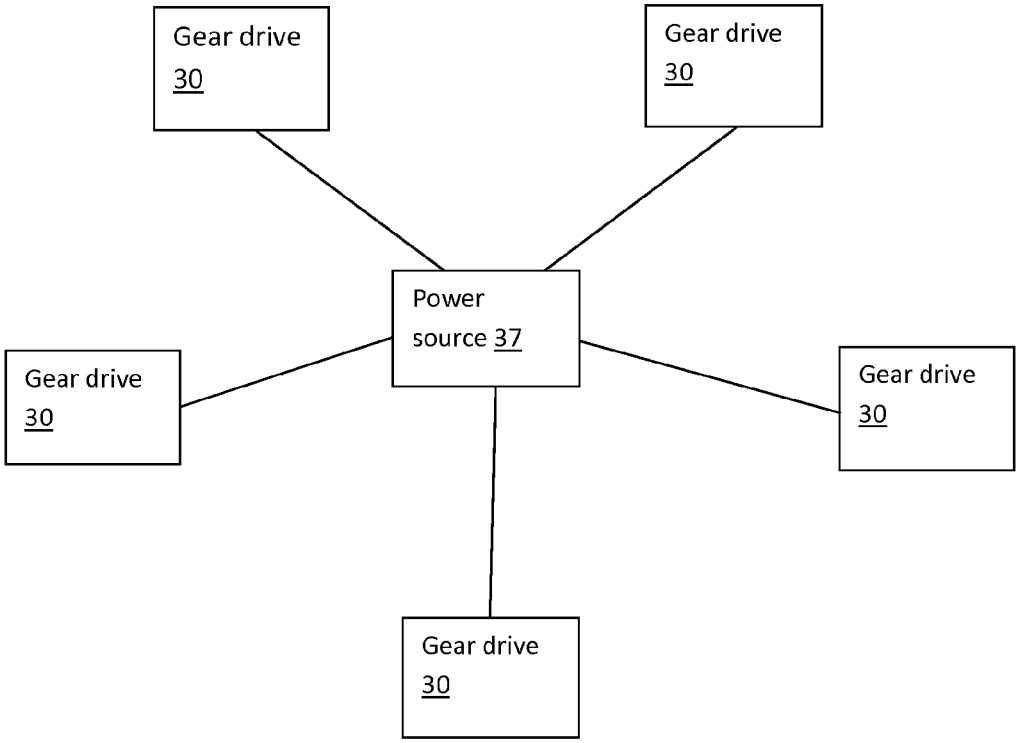
FIG. 11 is a schematic view of an embodiment of the invention.

Referring to FIG. 10, in addition to the features of the pinion gears 36, drive mounting plate 20, gear pedestal plate 71 and circular gear 72 described above in relation to the first embodiment, the location and configuration of the kingpin 740 and the upper shoulder 743 can be seen.

Those having ordinary skill in this art will appreciate that the structural system of the invention is modular in construction, such that each component may be easily shipped in conventional and relatively inexpensive fashion and then easily assembled during installation at the intended end use location. Similarly, maintenance and repairs are substantially simplified.

In addition, the present invention provides a slewing actuator system suitable for use on ships, land surfaces or docks, which possesses a more compact design that allows for a greater amount of rotational range of the boom attached thereto, particularly on ships or at other use locations having a small clearance envelope.

The present invention also provides a slewing actuator system which is easy to install, lighter than conventional slewing actuator systems, and which can be easily disassembled into separate portions for shipping, if necessary, and subsequent reassembly.

The present invention further provides a boom slewing actuator system which safely prevents boom slippage, and which securely locks the boom in place when hydraulic pressure is removed.

Other embodiments consistent with the present invention will become apparent from consideration of the specification and the practice of the invention disclosed therein.

Accordingly, the specification and the embodiments are to be considered exemplary only, with the true scope and spirit of the invention being disclosed by the following claims.

We claim:

1. A slewing actuator system for rotating a boom structure and constructed and arranged to be secured to a support, the system comprising:

(i) a cylindrical support member having a lower end constructed and arranged to be functionally coupled to the support, and an upper end, the cylindrical support member having a substantially vertical axis;

(ii) a drive mounting member having a central bore therethrough, the drive mounting member extending outwardly and substantially orthogonally from the vertical axis of the cylindrical support member, the drive mounting member being constructed and arranged for receiving a portion of the cylindrical support member within the central bore;

(iii) gearing means comprising:

(a) a gear assembly; and (b) at least one rotating gear drive constructed and arranged to be fixed to the drive mounting member and operatively connected to the gear assembly, the gear assembly further comprising a rotating gear constructed and arranged to be operatively driven by the at least one gear drive, and a gear plate in interlocking engagement with the rotating gear; and (iv) a boom support means mounted to a means for rotatably coupling the boom support means to the cylindrical support member, the boom support means having (a) a surface constructed and arranged to receive and releasably secure the boom structure thereto; and (b) a central region and two lateral regions having respective outer edges; wherein, when the system is in an operating position, (A) the boom support means is rotatably mounted proximate to the upper end of the cylindrical support member and is configured to rotate about the substantially vertical axis of the cylindrical support member;

(B) the gear assembly is positioned substantially horizontally and comprises a central opening in the gear plate, the central opening having a vertical axis that is coaxial with the vertical axis of the cylindrical support member, a portion of the cylindrical support member being positioned within the central opening, such that the central opening surrounds a portion of the cylindrical support member; and (C) the gearing means imparts rotational movement to the boom support means.

2. A slewing actuator system according to claim 1, further comprising a pedestal constructed and arranged to surround the cylindrical support member substantially concentrically for at least a portion of a height of the cylindrical support member.

3. A slewing actuator system according to claim 2, wherein the pedestal comprises a substantially cylindrical inner wall and an outer wall having a cross-sectional configuration of a regular polygon.

4. A stewing actuator system according to claim 2, wherein the pedestal is secured to the support, and has an upper surface, and the drive mounting member is constructed and arranged to be mounted on and secured by the upper surface of the pedestal.

5. A slewing actuator system according to claim 2, wherein the drive mounting member is constructed and arranged to be supported at its lower surface at least proximate its lateral edges by a plurality of wing support members connected to the pedestal.

6. A slewing actuator system according to claim 2, further comprising a retainer plate secured to the pedestal at a lower portion.

7. A slewing actuator system according to claim 1, wherein the cylindrical support member is a tube, having an upper portion and a lower portion.

8. A slewing actuator system according to claim 7, further comprising a cylindrical connector operatively coupled to the lower surface of the boom support means and at a second end to the drive mounting member, wherein the tube is constructed and arranged to be secured at its lower portion to the support, and the cylindrical connector is constructed and arranged to rotatably surround at least the upper portion of the tube, such that the cylindrical connector rotates about the cylindrical support member.

9. A slewing actuator system according to claim 8, wherein the drive mounting member is mounted proximate a lower portion of the pedestal.

10. A slewing actuator system according to claim 8, wherein the gear assembly has a proximal end constructed and arranged to be secured to the cylindrical connector.

11. A slewing actuator system according to claim 7, further comprising an internal support ring which at least partially encloses the cylindrical support member proximate its upper end.

12. A slewing actuator system according to claim 7, wherein the cylindrical support member has an internal reinforcing disc which substantially encloses the lower end of the cylindrical support member.

13. A slewing actuator system according to claim 1, wherein the cylindrical support member is a solid kingpin.

14. A slewing actuator system according to claim 1, wherein the support is selected from a base plate, a pedestal structure comprising a base plate, and a pedestal structure.

15. A slewing actuator system according to claim 1, wherein the support is a pedestal comprising a support plate, and the cylindrical support member is a tube constructed and arranged to be secured to the support plate.

16. A slewing actuator system according to claim 1, wherein each gear drive comprises an integral brake.

17. A slewing actuator system according to claim 1, comprising a plurality of gear drives each fixed substantially equidistantly from the vertical axis of rotation of the boom support means.

18. A slewing actuator system according to claim 17, wherein each of the plurality of gear drives shares a common power source.

19. A slewing actuator system according to claim 1, wherein each gear drive is constructed and arranged to be powered by a source selected from hydraulic and electrical power.

20. A slewing actuator system according to claim 1, wherein the gear assembly has a proximal end constructed and arranged to be secured to the cylindrical support member.

21. A stewing actuator system according to claim 1, wherein the gear plate has a plurality of spaced-apart openings from its upper surface through to its lower surface.

22. A slewing actuator system according to claim 1, wherein the boom support means comprises a central opening from its upper surface through to its lower surface and constructed and arranged to rotatably surround the upper end of the cylindrical support member.

23. A slewing actuator system according to claim 22, further comprising a cap plate secured to an upper surface of the boom support means over the central opening.

24. A slewing actuator system according to claim 22, wherein the means for rotatably coupling the boom support means to the cylindrical support member further comprises at least one low friction bushing between the central opening and the upper end of the cylindrical support member.

25. A slewing actuator system according to claim 1, wherein the boom support means comprises a trunnion weldment and each lateral region includes a trunnion pin.

26. A slewing actuator system according to claim 25, wherein each trunnion pin is operatively connected to one of a pair of boom hubs each constructed and arranged to be operatively connected to the boom structure.

27. A slewing actuator system according to claim 1, wherein the cylindrical support member has an outer surface which includes an annular retaining location constructed and arranged to receive and support the lower surface of the boom support means.

28. A slewing actuator system according to claim 27, wherein the annular retaining location is selected from a protruding ledge and a detent provided at the outer surface of the cylindrical support member.

29. A slewing actuator system according to claim 28 further comprising at least one low friction thrust washer between the annular retaining location and the boom support means.

30. A slewing actuator system according to claim 1, wherein a horizontal distance between the vertical axis of rotation and each lateral edge of the boom support means exceeds a horizontal distance between a centre and an outer limit of the gear assembly.

* * * * *